US011148192B2

(12) United States Patent
Sosinsky et al.

(10) Patent No.: US 11,148,192 B2
(45) Date of Patent: Oct. 19, 2021

(54) SHROUD FOR BILLET CASTING

(71) Applicant: Nucor Corporation, Charlotte, NC (US)

(72) Inventors: David J. Sosinsky, Carmel, IN (US); Marcie M. Hinker, Bourbonnais, IL (US)

(73) Assignee: Nucor Corporation, Charlotte, NC (US)

( * ) Notice: Subject to any disclaimer, the term of this patent is extended or adjusted under 35 U.S.C. 154(b) by 0 days.

(21) Appl. No.: 16/601,973

(22) Filed: Oct. 15, 2019

(65) Prior Publication Data

US 2020/0038943 A1 Feb. 6, 2020

Related U.S. Application Data

(63) Continuation of application No. 15/628,024, filed on Jun. 20, 2017, now Pat. No. 10,478,890.

(60) Provisional application No. 62/352,660, filed on Jun. 21, 2016.

(51) Int. Cl.

| | |
|---|---|
| ***B22D 11/055*** | (2006.01) |
| ***B22D 11/047*** | (2006.01) |
| ***B22D 11/059*** | (2006.01) |
| ***B22D 11/11*** | (2006.01) |
| *B22D 11/053* | (2006.01) |

(52) U.S. Cl.

CPC ..... *B22D 11/055* (2013.01); *B22D 11/047* (2013.01); *B22D 11/059* (2013.01); *B22D 11/11* (2013.01); *B22D 11/053* (2013.01)

(58) Field of Classification Search

CPC ... B22D 11/047; B22D 11/055; B22D 11/059; B22D 11/11; B22D 11/053

USPC ..... 164/437, 488, 478

See application file for complete search history.

(56) References Cited

U.S. PATENT DOCUMENTS

| | | | |
|---|---|---|---|
| 3,439,735 | A | 4/1969 | Holmes |
| 3,616,843 | A | 11/1971 | Newhall et al. |
| 3,908,734 | A | 9/1975 | Pollard |
| 3,963,224 | A | 6/1976 | Pollard |
| 4,091,861 | A | 5/1978 | Thalmann et al. |
| 4,155,398 | A | 5/1979 | Trentini et al. |
| 4,200,137 | A | 4/1980 | Zavaras et al. |
| 5,762,126 | A | 6/1998 | Assefpour-Dezfully et al. |
| 5,918,662 | A | 7/1999 | Tezuka et al. |
| 5,979,719 | A | 11/1999 | Bayly |
| 6,070,649 | A | 6/2000 | Urlau et al. |

(Continued)

FOREIGN PATENT DOCUMENTS

| | | | |
|---|---|---|---|
| CN | 1362304 | A | 8/2002 |
| CN | 101185956 | A | 5/2008 |

(Continued)

*Primary Examiner* — Kevin P Kerns

(74) *Attorney, Agent, or Firm* — Hahn Loeser & Parks LLP

(57) ABSTRACT

Methods of billet casting are provided herein. The methods may include the steps of assembling a billet caster with a shroud extending from a tundish to above a mold such that the shroud does not reach molten metal in the mold, delivering molten metal from a ladle into the tundish, delivering molten metal from the tundish through the shroud to the mold, the shroud inhibiting contact between the molten metal and air, casting the molten metal into billets in the mold and cooling the billets below the mold with a coolant spray, and delivering the cooled billet to a runout table to be cut to length.

16 Claims, 6 Drawing Sheets

(56) References Cited

U.S. PATENT DOCUMENTS

| | | | |
|---|---|---|---|
| 6,309,442 | B1 | 10/2001 | Usher |
| 7,363,959 | B2 | 4/2008 | Hanna et al. |
| 8,657,164 | B2 | 2/2014 | Reeves et al. |
| 8,763,679 | B2 | 7/2014 | Albrecht-Früh et al. |
| 8,887,969 | B2 | 11/2014 | Steiner et al. |
| 10,478,890 | B1 * | 11/2019 | Sosinsky et al. .... B22D 11/055 |
| 2004/0164466 | A1 | 8/2004 | Koffron et al. |
| 2005/0211411 | A1 | 9/2005 | Fukase et al. |

FOREIGN PATENT DOCUMENTS

| | | | |
|---|---|---|---|
| CN | 201346620 | Y | 11/2009 |
| CN | 201436111 | U | 4/2010 |
| CN | 101524752 | B | 2/2011 |
| CN | 201744633 | U | 2/2011 |
| CN | 101428335 | B | 11/2011 |
| CN | 103008639 | A | 4/2013 |
| CN | 203030858 | U | 7/2013 |
| CN | 103252466 | A | 8/2013 |
| CN | 203209684 | U | 9/2013 |
| CN | 103611895 | A | 3/2014 |
| CN | 203956074 | U | 11/2014 |
| CN | 103008588 | B | 12/2014 |
| CN | 102962445 | B | 6/2015 |
| JP | 11245003 | A | 9/1999 |
| JP | 5154997 | B2 | 2/2013 |
| JP | 5164893 | B2 | 3/2013 |
| JP | 5716414 | B2 | 5/2015 |
| KR | 2020080001834 | U | 6/2008 |
| KR | 2020110009324 | U | 10/2011 |
| KR | 101400039 | B1 | 5/2014 |
| WO | 2005021187 | A1 | 3/2005 |
| WO | 2015055569 | A1 | 4/2015 |

* cited by examiner

SHROUD FOR BILLET CASTING

CROSS-REFERENCE TO RELATED APPLICATIONS

This application is a continuation of U.S. patent application Ser. No. 15/628,024 filed on Jun. 20, 2017, now U.S. Pat. No. 10,478,890, which claims priority to, and the benefit of, U.S. Provisional Application No. 62/352,660 filed on Jun. 21, 2016, which are hereby incorporated by reference.

BACKGROUND AND SUMMARY

This invention relates generally to methods of billet casting. Steel is usually produced in a continuous casting process, which involves continuous delivery of molten metal to a caster during a casting campaign. In billet casting, the molten metal is delivered from ladle into a tundish and continuously fed into a mold which simultaneously creates several strands of steel, each strand shaped in a cross section of desired product. Generally, the tundish holds an amount of the molten metal so ladles can be changed without disrupting casting and controls the flow of said molten metal into the mold. After the mold, the strands are taken through guides that take the strands in a curvilinear path and horizontally orient the strands for further processing. The material may be sprayed with a cooling liquid at any point after exiting the mold. After the material has sufficiently cooled and is oriented on the runout table the billets are cut to the desired lengths.

Billet casting may be done in continuous casting the same as slabs with subentry nozzles, but that is generally product dependent and expensive. This method requires significant investment in both the continuous casting equipment and ongoing maintenance. There are also additional characteristics of continuous casting with a subentry nozzle which make it unsuitable for traditional billet casting. There is a need to provide a cost-efficient method of billet casting which produces billets of improved steel quality. Further, billet casting generally employs a mold or molds having a shape of the desired cross sections for the steel products produced. A cost effective method is needed which can eliminate or reduce the amount of waste of casting and improve the quality of a billet.

Disclosed is an efficient method of billet casting which produces billets of improved steel quality without using traditional slab continuous casting. The disclosed method of billet casting comprises the steps of: assembling a billet caster with a shroud extending from a tundish to just above a mold such that the shroud does not contact the molten metal in the mold, delivering the molten metal from a ladle and into the tundish, delivering the molten metal from the tundish through a shroud and to the mold, the shroud inhibiting contact between the molten metal and surrounding atmosphere, casting the molten metal into billets from the mold and cooling the billets below the mold with coolant spray to form cooled billets, and delivering the cooled billets to a runout table to be cut to length. In some examples, the shroud extends between about 1 and 55 mm above the meniscus of the molten metal in the mold. More specifically, the shroud may extend between 1 and 15 mm above the meniscus of the molten metal in the mold.

In methods of billet casting, the shroud comprises a passage for delivering the molten metal to the mold. The passage in the shroud may be tapered from a first shroud end near the tundish to a second shroud end near the mold and above the meniscus in the mold. Further, the passage at the first shroud end may be larger than the passage at the second shroud end and may be tapered. In other examples, the shroud may not be tapered.

In some methods of billet casting, the shroud is formed of refractory material. In particular examples, the refractory material is an alumina-based material. The refractory material may be entire shroud or a portion of the shroud. By example, the refractory material has a thickness of ⅛ inch or more. The refractory material may additionally or alternatively have a variable thickness. Further, the refractory material may be encased by a metal casing. In a particular example, the metal casing has a thickness of 1.5 mm.

In various methods of billet casting, the shroud comprises an upper portion located near the tundish and a lower portion located near the mold, where the upper portion is located above the lower portion. The upper portion may be formed of a material different than the lower portion. By example, the upper portion may comprise a pressed silica outer portion and a zirconia inner portion. One or both portions may be encased by a metal casing, such as previously described. In one example, the upper portion forms a nozzle with a nozzle passage extending from near the tundish to the lower portion. The nozzle passage may comprise a first nozzle end near the tundish and a second nozzle end near the lower portion, where the nozzle passage at the first nozzle end is larger than the nozzle passage at the second nozzle end. By example, the nozzle passage at the first nozzle end may have a diameter of 28.7 mm and the nozzle passage at the second nozzle end may have a diameter of 17.5 mm. Further, a passage of the lower portion may have a larger diameter than the passage at the second nozzle end.

The shroud extends from tundish to just above the meniscus of the molten metal in the mold. The molten metal in the shroud does not come into contact with the surrounding atmosphere. In this way, the steel composition of the molten metal is expected to absorb up to about 85% less oxygen, nitrogen, and other elements and compounds from the surrounding atmosphere. The shroud may extend to any selected height above the meniscus of the molten metal in the mold, and may extend to between 1 mm and 55 mm above the meniscus of the molten metal in the mold or to between 1 mm and 15 mm above the meniscus of the molten metal in the mold.

The method may further comprise assembling a dummy bar adapted to start casting of shrouds in the mold, and after starting casting, allows the billet casting campaign to proceed, or continue once started. The dummy bar may be a solid piece of metal billet stock with the same cross section as the desired end product. The dummy bar is positioned into the mold from below, to start casting. After the dummy bar is in position, molten metal is delivered from the tundish through the shroud and into the mold. The dummy bar then moves through a plurality of rollers to the run out table, allowing a next campaign of casting to begin.

After the dummy bar passes through the casting station, the dummy bar is removed from the newly formed cast strand. This removal may take the form of rolling the dummy bar through a series of separate rollers. The dummy bar may then stay in that position until the start of another casting campaign.

BRIEF DESCRIPTION OF THE DRAWINGS

The invention may be more fully illustrated and explained with reference to the accompanying drawings in which.

DETAILED DESCRIPTION OF THE DRAWINGS

Figure 1:
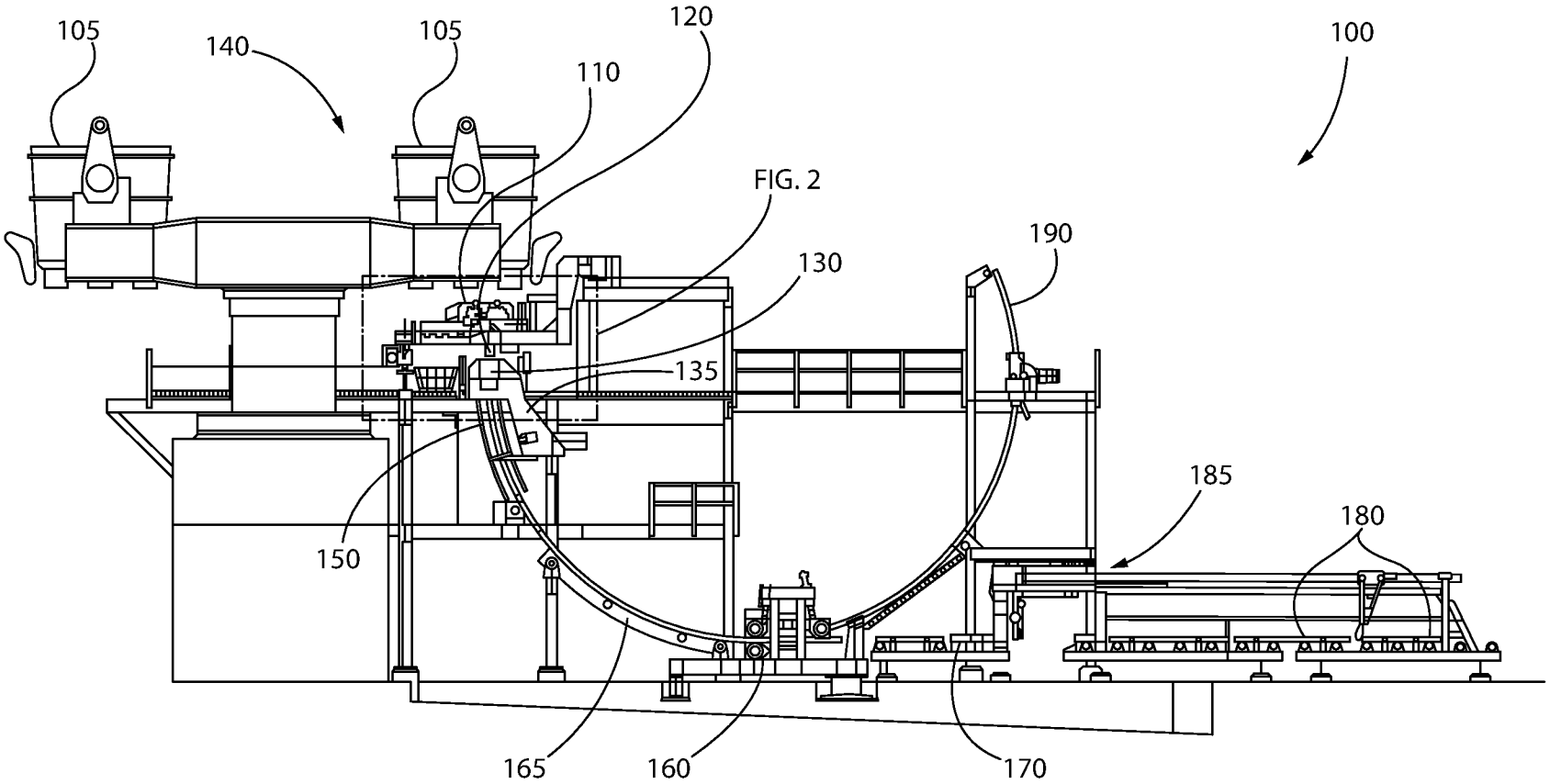
FIG. 1 illustrates a billet caster embodying the present invention.

FIG. 1 illustrates a billet caster 100 for casting billets from molten metal, by the method presently disclosed. One or more ladles 105 containing molten metal generally from 70 to 110 tons in size for casting are positioned on a turret 140 from a wheeled carrier (not shown). Generally the molten metal is produced in a steelmaking furnace (not shown) such as an electric arc furnace. The molten metal is delivered in ladles 105 from the steel making furnace to the caster on a carrier transport for the casting campaign. Ladles 105 may not only serve to hold molten metal for casting, but also to prepare the specification of the steel composition for casting in a ladle metallurgy furnace (not shown) while supported on the carrier. In any case, the molten metal in the ladle 105 is delivered from the ladle 105 to the tundish 110 by means of a slide gate on the bottom portion of the ladle 105. The molten metal flows through the slide gate and into the tundish 110. Alternatively, the molten metal may be delivered into the tundish by rotating the ladle 105 until the metal pours over into the tundish 110.

Once in the tundish 110, the molten metal is delivered in a controlled flow from tundish 110 through shroud 120 into mold 130 at a generally controlled rate. A tundish 110 may perform one or more other functions in the steel casting process. For example, the molten steel may reside in tundish 110 for a time sufficient to reduce or eliminate fluid turbulence in the molten metal before delivery through shroud 120 for casting. The tundish 110 may contain a relief on the upper portion, which enables over flow of molten melt to be deposited into the spillover box 115 when the tundish 110 is near full capacity, either by intentional or unintentional means.

Shroud 120 extends from tundish 110 to just above mold 130, and the molten metal in the shroud 120 does not come into contact with the surrounding atmosphere. In this way, the steel composition of the cast billets is of desired quality. The quality of the steel composition is not inhibited by pick up of oxygen, nitrogen, and other elements or compounds from the surrounding atmosphere.

Figure 2:
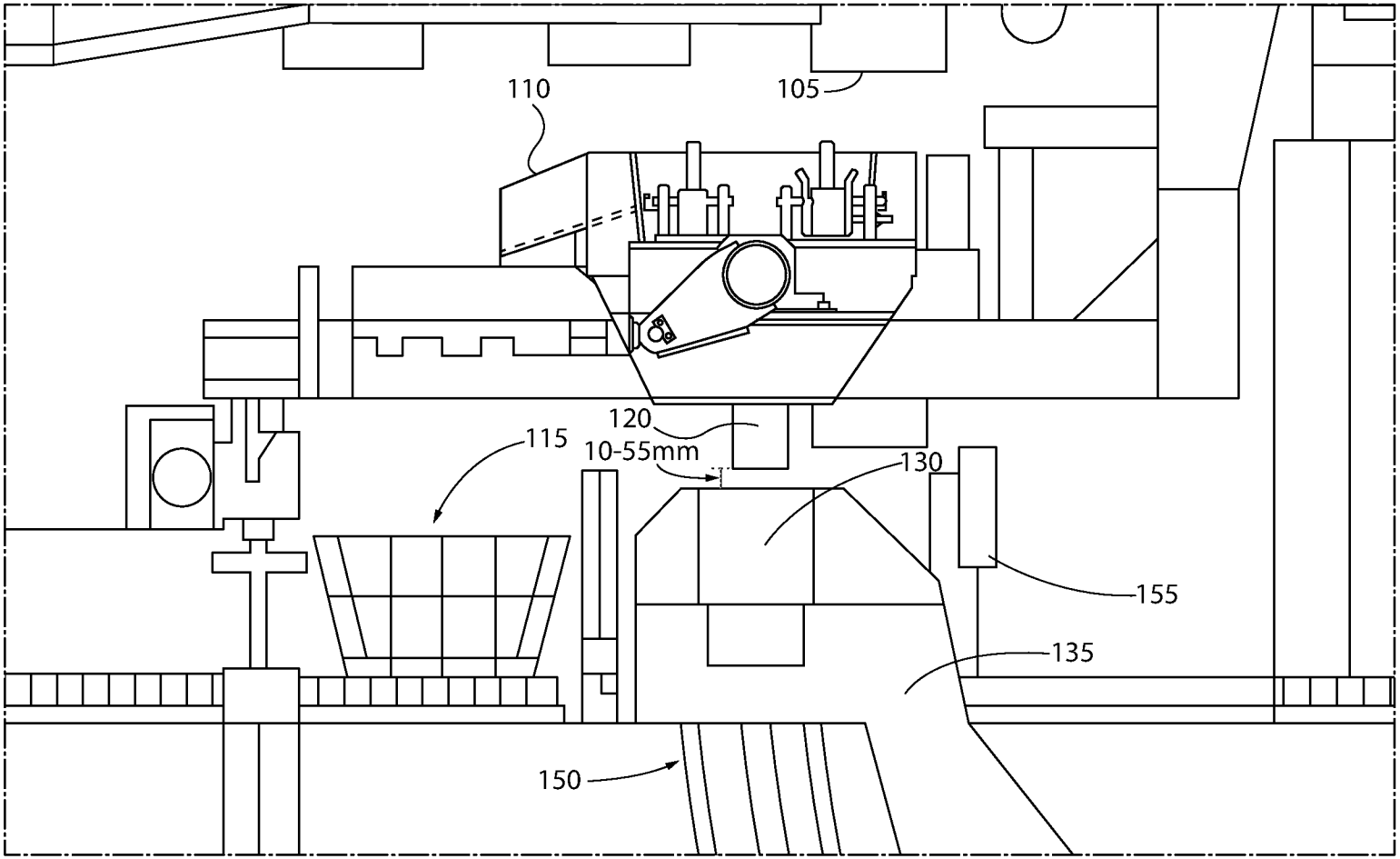
FIG. 2 illustrates a close-up view of a portion of the billet caster of FIG. 1 showing features of the present invention.

FIG. 2 illustrates close-up view of the tundish 110, shroud 120, mold 130, spillover box 115, and operator's swing panel 155. Shroud 120 may extend to any height above the meniscus of the molten metal in mold 130 according to particular configurations of the billet caster. The shroud 120 may extend to between about 1 mm and 55 mm above the meniscus of the molten metal in mold 130 or to between about 1 mm and 15 mm above the meniscus of the molten metal in mold 130. It will be apparent that the spacing between shroud 120 and mold 130 is exaggerated in FIG. 2, and not shown to scale, to better illustrate how shroud 120 extends from tundish 110 to just above the meniscus of the molten metal in mold 130.

Shroud 120 substantially encloses the space surrounding the molten metal as it moves between tundish 110 and mold 130. The shroud 120 then inhibits contact between the molten metal and surrounding atmosphere. In addition, allowing the shroud 120 to extend from tundish 110 to just above the meniscus of the molten metal in mold 130 ensures that the shroud 120 does not come in contact with the molten metal delivered into the mold 130.

Shroud 120 may, at least in part, be made of a refractory material, such as a refractory alumina-based material, and may be of any suitable thickness. Shroud 120 may have a thickness of about ⅛ inch or greater, and shroud 120 may have a thickness of about 1 inch or greater. As those skilled in the art will appreciate, shroud 120 may be made of other materials and with different thicknesses, according to the particular specifications of billets being cast, within the scope of the present disclosure.

Mold 130 receives molten metal from the shroud 120 into and casts at least one strand. There is generally a plurality of strands for cast simultaneously, such as two, three, four, five, or more. The mold 130 can provide initial cooling of the molten metal so that at least an outer portion, or shell, of the cast strands cool and are solidified to provide solid structure to the strand, even though inner portions of the strands may remain molten or mushy as casting proceeds. Guide section 165 may have one or more internal tubes to circulate cooling water to cool the molten metal. The copper tube or tubes may have a distinct cross-sectional shape, such as a rectangular cross-section, L-shape cross-section, circular cross-section, or other cross-sectional shape as desired. Additionally, the billet caster 100 may include a mold oscillation unit 135 to prevent adherence of molten metal to the mold 130. The mold oscillation unit 135 can oscillate the mold at a pre-determined frequency and amplitude to ensure that molten metal does not adhere to the mold. The mold may also be lubricated, such as with an oil or a mold powder, to prevent the molten metal from sticking to the mold 130.

Billets are conveyed out of mold 130 through guide section 165 in the desired product cross-sections and are cooled by coolant sprays from spray risers 150. Spray risers 150 may be deployed along a portion of guide section 165, providing cooling for a length of guide section 165 between about 0.5 m to about 5 m. The coolant spray may be water forced through nozzles of the spray risers 150, which break the water into droplets that efficiently cool the strands. Spray risers 150 may deliver coolant spray in a partial or full cone pattern over the cast strands to assist in cooling of the strands as they move along guide section 165.

Figure 3A:
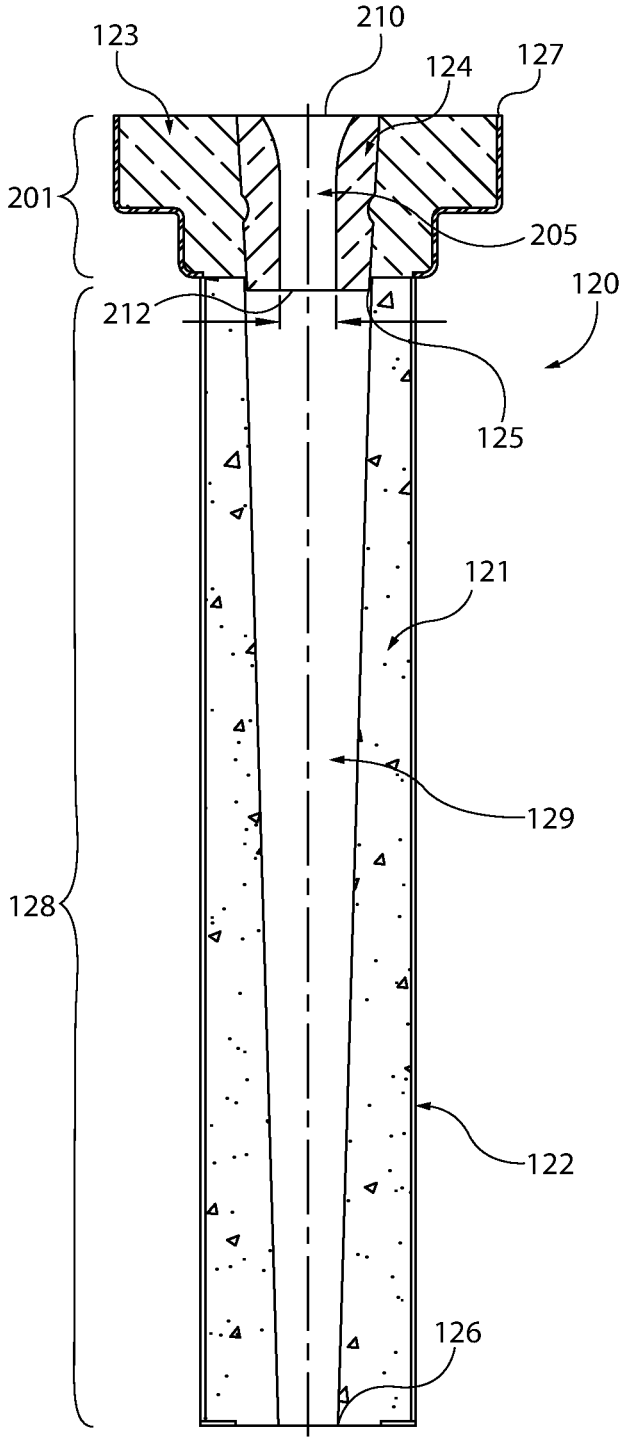
FIGS. 3A and 3B illustrate a shroud useful in performing some embodiments of the present invention.
Figure 3B:
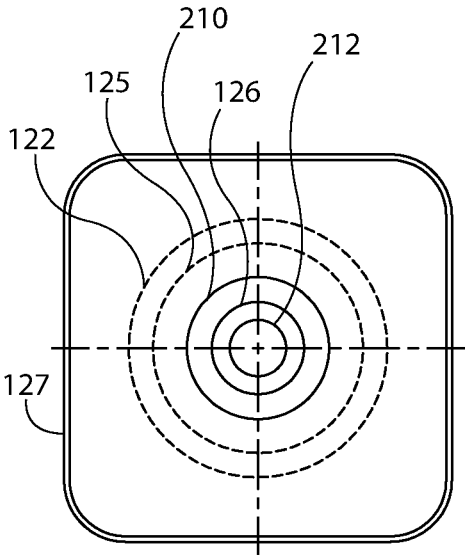

FIGS. 3A and 3B illustrate a shroud 120 useful in performing some embodiments of the present invention. FIG. 3A presents a side view in cross-section of shroud 120, and FIG. 2B presents shroud 120 as viewed from the top looking down through the shroud.

As noted above, shroud 120 may comprise an alumina-based material 121. As illustrated in FIG. 3A, a lower portion 128 comprises alumina-based material 121, or other refractory material. The alumina-based material 121, or other refractory material, may have a thickness of about ⅛ inch or more. The alumina-based material 121, or other refractory material, of the lower portion 128 may be encased by a metal casing 122, such as a steel casing. Metal casing 122 may be about 1.5 mm thick, although it is understood that the metal casing 122 may be made to any suitable thickness. Shroud 120 may also have an upper portion including a pressed silica outer portion 123 and a zirconia inner portion 124. The upper portion may form a nozzle 201 extending from the tundish (as described above and not shown in FIG. 3A) having outer and inner portions 123 and 124 extending down from the tundish to the lower portion 128 where the lower portion extends down from the nozzle 201 to just above the meniscus of the molten metal in the mold (as described above and not shown in FIG. 3A). The upper portion of shroud 120 may also be encased by a metal casing 127, which may have a thickness of about 1.5 mm.

Referring to FIGS. 3A and 3B, a nozzle passage 205 is formed in the nozzle 201. The nozzle passage 205 may be tapered from a first nozzle end 210 to a second nozzle end 212 where the nozzle passage 205 at the first nozzle end 210 is larger than the nozzle passage 205 at the second nozzle end 212. The first nozzle end 210 is near the tundish and the second nozzle end 212 is near the lower portion 128. Similarly, a passage 129 in the lower portion 128 of the shroud 120 may be tapered to be larger at a first lower portion end 125 near the nozzle 201, and narrower at a second lower portion end 126 just above the meniscus of the molten metal in the mold 130, relative one another.

The alumina-based material 121, or other refractory material, may have a varying thickness. As FIG. 3A illustrates, the thickness of the alumina-based material 121, or other refractory material, is varying to implement the tapered passage in the shroud. In particular, the alumina-based material 121, or other refractory material, is, itself, tapered. A tapered passage 129 in the shroud 120, as illustrated in FIG. 3A, inhibits contact between a stream of molten steel and surrounding air, and inhibit re-oxidation of molten steel as it is poured from a tundish to a mold. In one embodiment, the first nozzle end 210 of nozzle 201 may have a nozzle passage diameter of about 28.7 mm and the second nozzle end 212 of nozzle 201 may have a nozzle passage diameter of about 17.5 mm. In another embodiment, the passage at the second lower portion end 126 of shroud 120 may have a diameter of about 18.5 mm or larger. Thus, the passage in the second lower portion end 126 of shroud 120 has a larger diameter than the nozzle passage 205 at the second nozzle end 212.

Figure 3C:
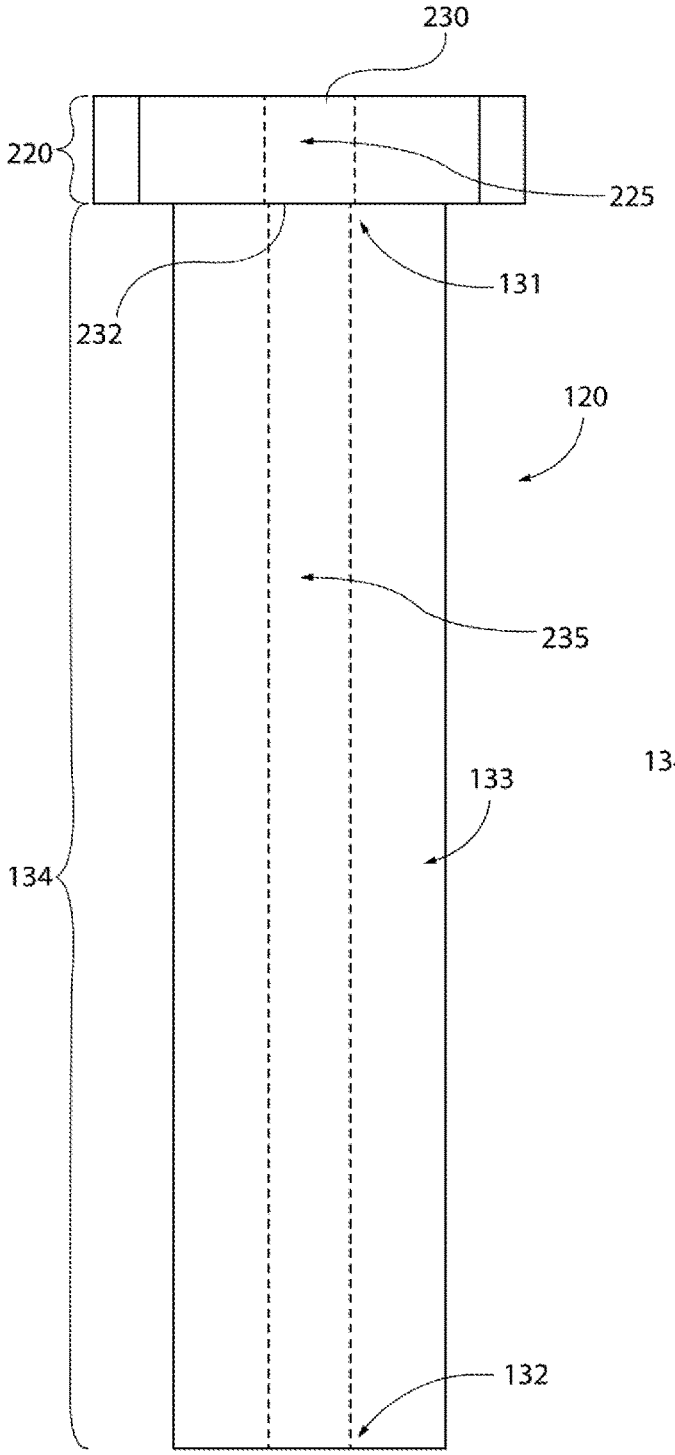
FIGS. 3C and 3D illustrate an alternative shroud useful in performing some embodiments of the present invention.
Figure 3D:
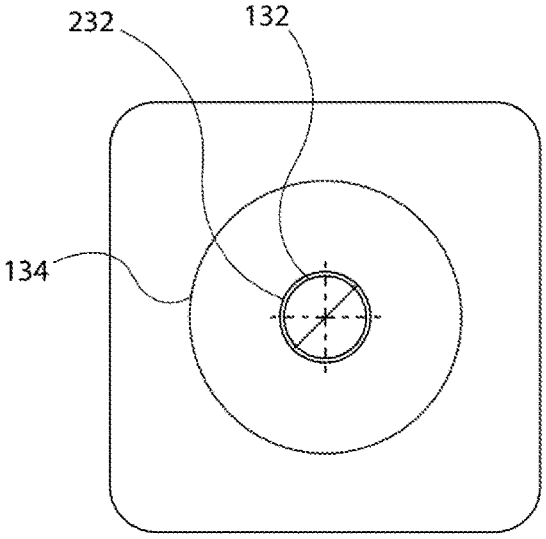

FIGS. 3C and 3D illustrate some embodiments of a shroud 120 useful in performing embodiments of the present invention. FIG. 3C presents a side view in cross-section of shroud 120, and FIG. 3D presents shroud 120 as viewed from the top looking down through the shroud. Shroud 120 of FIGS. 3C and 3D may, as described above, comprise an alumina-based material 133, or other refractory material, and may have an upper portion and a lower portion 134, as previously described above, with the upper portion forming a nozzle 220. Nozzle 220, as shown by FIG. 3C, has a passage 225 at a first nozzle end 230 near the tundish (not shown in FIG. 3C) that is substantially the same size as a passage at the second nozzle end 232 near the lower portion 134. Similarly, the alumina-based material 133, or other refractory material, of the lower portion 134 of the shroud 120 may not be tapered, so that a passage 235 at the first lower portion end 131 near nozzle 220 is substantially the same size as a passage at the second lower portion end 132 just above the meniscus of the molten metal in the mold. As FIG. 3D illustrates, in one embodiment the passage at the second nozzle end 232 of nozzle 220 may have a diameter substantially similar to a diameter of the passage at the second lower portion end 132 of shroud 120.

Referring again to FIG. 1, a dummy bar 190 may be included in exemplary embodiments to start the billet casting process. The dummy or starting bar 190 may be adapted to swing into place and feed the strands through mold 130 and guide section 165. The dummy or starting bar 190 is adapted to swing away, after a pre-determined length of time, to allow billet casting to proceed. The dummy bar 190 may be controllable, for example, by an operator's swing panel 155.

The mold 130 enables the strands to be cooled to have a solidified outer surface and move out of the mold 130 and through the guide section 165. The guide section 165 may contain a curved portion to enable partially cooled strands from the caster to pass out of mold 130 and move into a horizontal orientation, at the run out table. The cooled strands move onto runout tables 170 and 180, where a cutting torch 185 cuts the billets to length. Generally, it is desirable to provide finished billets that are straight, billets being guided by a curved guide section 165 and generally remaining internally mushy and semi-solid until conveyed horizontally onto runout tables 170 and 180.

Cooled billets may be delivered from guide section 165 to runout tables 170 and 180. Cooled billets may also pass through a straightener 160 prior to being delivered to runout tables 170 and 180 for cutting. As the strands are conveyed along runout tables 170 and 180, the billets are cut into a desired length. In one embodiment, a cutting torch 185 may cut the billets. The cooled and cut billets are gathered from runout table 180 after cutting occurs.

Figure 4:
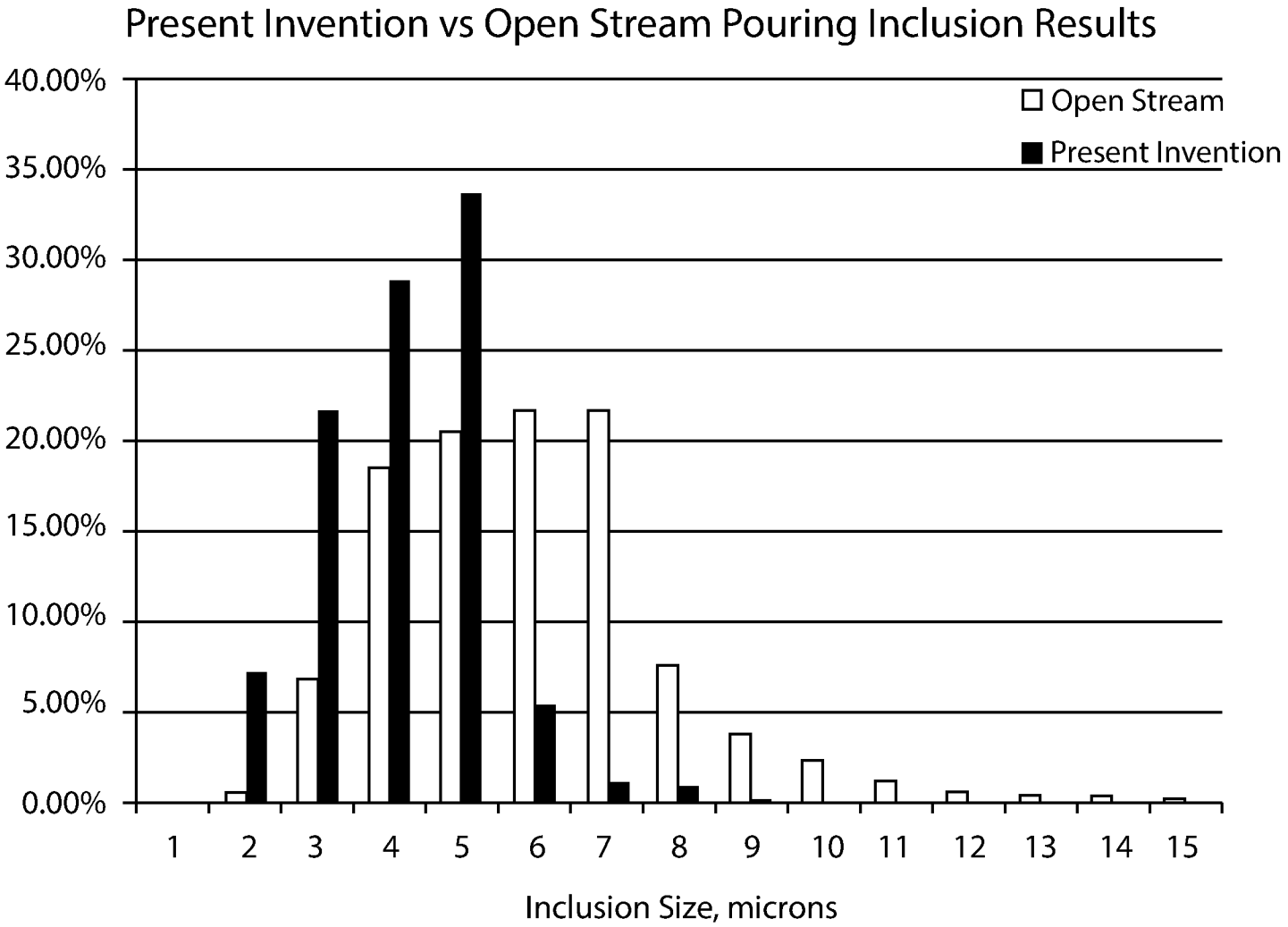
FIGS. 4 and 5 are charts demonstrating reduction in re-oxidation inclusions in steel produced by a billet caster as described herein.
Figure 5:
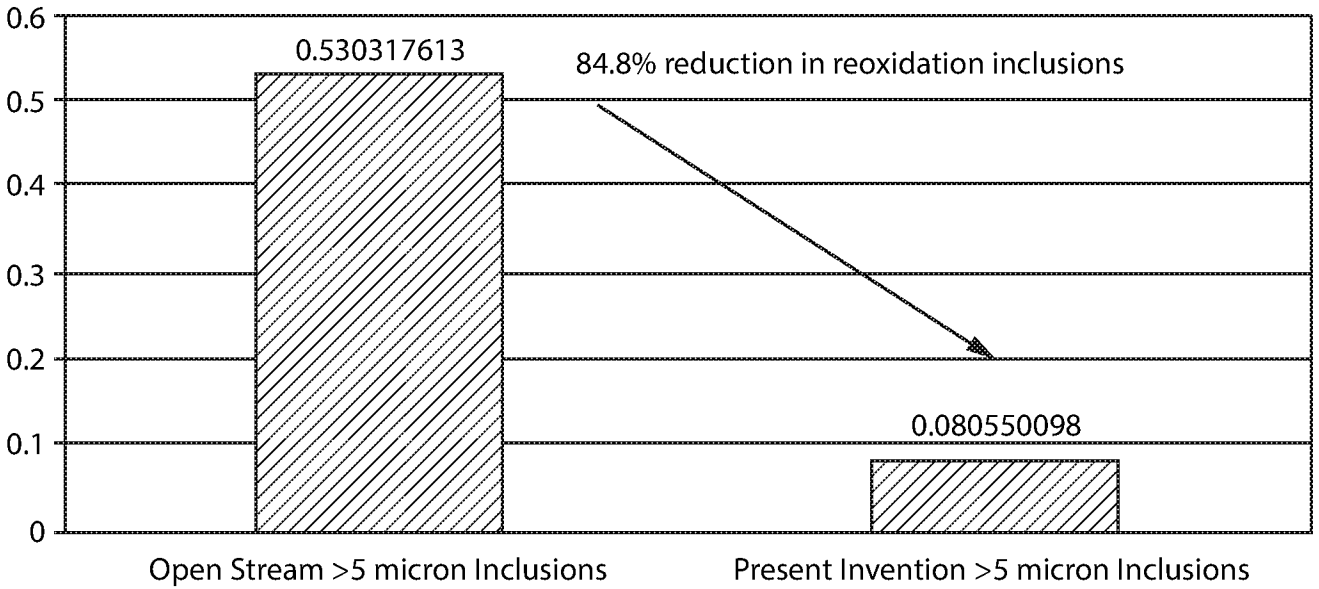

FIGS. 4 and 5 are charts reporting test results of re-oxidation inclusions present in steel produced by a billet caster of the present invention as described above, compared to steel produced by a billet caster not using the present invention. Most exogenous inclusions are formed when deoxidized steel is exposed to an oxidizing media such as air. During casting with a prior art caster, oxygen pick-up can take place through either direct contact between the falling molten metal stream and surrounding atmosphere, or by entrainment of air with the molten metal stream into the mold pool, where the resulting re-oxidation products are entrained by the pouring stream and entrapped in the solidifying steel. Re-oxidation inclusions are usually distinguishable from indigenous inclusions on the basis of size and composition. Re-oxidation inclusions are usually larger (greater than about 5 microns) than indigenous types, and in composition they are almost always oxides. By contrast, indigenous inclusions may be produced by chemical reactions between dissolved materials in the steel bath during the time the steel is in the ladle or tundish, and are generally smaller than re-oxidation inclusions (about 5 microns or smaller). Steel produced with a large number of re-oxidation inclusions (larger inclusions greater than about 5 microns) has a greater chance of breaking, and may be particularly susceptible to breaking where inclusions line up near each other within the steel.

The chart of FIG. 4 shows results of tests that involved equipping a pouring stream with the present invention as described above. Once steady state casting was achieved, billets produced by the present invention and corresponding billets produced by a prior art caster were sampled. Each of the samples was prepared for an Automated Feature Analysis (AFA), requiring the use of an Scanning Electron Microscope (SEM). In each sample, an area of 50 $mm^2$ was analyzed for inclusion composition and inclusion size. Every inclusion in the analysis area was analyzed. Once the AFA was completed, the data was tabulated to count the number of inclusions of each size (in 1 micron increments) across all samples and determine the percentage of each inclusion size relative to the total number of inclusions across all samples. As described above, inclusions larger than about 5 microns are generally exogenous inclusions resulting from re-oxidation of the steel as it is poured, while inclusions about 5 microns or smaller are generally indigenous inclusions.

As FIG. 4 illustrates, in billets produced by prior art open stream casting (e.g. by a prior art caster), more than 50% of inclusions had a size of 6 microns or larger corresponding to exogenous re-oxidation inclusions. These are the inclusions that are deleterious to the quality of the billet product as well as downstream products. By contrast, over 90% of the inclusions in steel produced by the present invention had a size of 5 microns or less corresponding to indigenous inclusions; only about 8% of the inclusions had a size of 6 microns or higher corresponding to re-oxidation inclusions.

The chart of FIG. 5 summarizes the detailed results of testing and analysis from FIG. 5, showing the percent of inclusions in billet steel greater than 5 microns in size. As FIG. 5 illustrates, over 53% of inclusions found in steel produced by prior art open stream methods had a size of greater than 5 microns, corresponding to re-oxidation inclusions. By contrast, steel produced using the present invention had only about 8% of inclusions greater than 5 microns, marking an 84.8% reduction in re-oxidation inclusions versus prior art methods, and an 84.8% improvement in produced billet product.

A reduction of re-oxidation inclusions would manifest itself in an improved steel product. An internally cleaner steel product leads to the finished product with more consistent properties, and with less risk of premature failure during use.

While the invention has been illustrated and described in detail in the foregoing drawings and description, the same is to be considered as illustrative and not restrictive in character, it being understood that only illustrative embodiments thereof have been shown and described, and that all changes and modifications that come within the spirit of the invention described by the following claims are desired to be protected. Additional features of the invention will become apparent to those skilled in the art upon consideration of the description. Modifications may be made without departing from the spirit and scope of the invention.

What is claimed is:

1. A system for billet casting, the system comprising:

a shroud and a mold, the shroud comprising an upper portion, a lower portion, and an open bottom, the upper portion and the lower portion define an enclosed passage within the shroud wherein the upper portion forms a nozzle with a nozzle passage extending to the lower portion, the nozzle passage comprising a first nozzle end at a first end of the upper portion and a second nozzle end near the lower portion where the enclosed passage of the lower portion has a larger diameter than the nozzle passage of the enclosed passage at the second nozzle end near the lower portion;

wherein the shroud extends from a tundish to above the mold for pouring a stream of molten metal within the shroud and configured to deliver the molten metal from the shroud to above a meniscus of the molten metal in the mold to inhibit contact between the molten metal and air; and wherein the shroud is maintained above the mold and does not contact the molten metal in the mold when the molten metal is delivered to the mold.

2. The shroud of claim 1 where the enclosed passage is tapered from a first shroud end at the upper portion to a second shroud end at the lower portion, opposite the first shroud end, and where the passage at the first shroud end is larger than the passage at the second shroud end.

3. The shroud of claim 1 where the enclosed passage is not tapered.

4. The shroud of claim 1 that is formed of a refractory material.

5. The shroud of claim 4 where the refractory material is an alumina-based material.

6. The shroud of claim 4 where the refractory material is encased by a metal casing.

7. The shroud of claim 4 where the refractory material has a variable thickness.

8. The shroud of claim 6 where the metal casing has a thickness of 1.5 mm.

9. The shroud of claim 1 where the upper portion is located above the lower portion and the upper portion is formed of a material different from the lower portion.

10. The shroud of claim 9 where the upper portion comprises a pressed silica outer portion and a zirconia inner portion.

11. The shroud of claim 10 where the upper portion is further encased by a metal casing.

12. The shroud of claim 11 where the metal casing has a thickness of 1.5 mm.

13. The shroud of claim 1 where the nozzle passage at the first nozzle end is larger than the nozzle passage at the second nozzle end.

14. The shroud of claim 13 where the nozzle passage at the first nozzle end has a diameter of 28.7 mm and the nozzle passage at the second nozzle end has a diameter of 17.5 mm.

15. The system of claim 1, wherein the shroud extends between 1 mm and 55 mm above the meniscus of the molten metal in the mold.

16. The system of claim 1, wherein the shroud extends between 1 mm and 15 mm above the meniscus of the molten metal in the mold.

* * * * *